US009674606B2

(12) United States Patent
Osako et al.

(10) Patent No.: US 9,674,606 B2
(45) Date of Patent: Jun. 6, 2017

(54) NOISE REMOVAL DEVICE AND METHOD, AND PROGRAM

(71) Applicant: Sony Corporation, Tokyo (JP)

(72) Inventors: Keiichi Osako, Tokyo (JP); Mototsugu Abe, Kanagawa (JP)

(73) Assignee: Sony Corporation, Tokyo (JP)

( * ) Notice: Subject to any disclaimer, the term of this patent is extended or adjusted under 35 U.S.C. 154(b) by 199 days.

(21) Appl. No.: 14/057,066

(22) Filed: Oct. 18, 2013

(65) Prior Publication Data

US 2014/0122064 A1 May 1, 2014

(30) Foreign Application Priority Data

Oct. 26, 2012 (JP) ..... 2012-236313

(51) Int. Cl.

| | |
|---|---|
| ***G10L 21/02*** | (2013.01) |
| ***H04R 3/00*** | (2006.01) |
| *G10L 21/0208* | (2013.01) |
| *G10L 21/0232* | (2013.01) |

(52) U.S. Cl.

CPC ..... *H04R 3/00* (2013.01); *G10L 21/0208* (2013.01); *G10L 21/0232* (2013.01); *H04R 2499/11* (2013.01)

(58) Field of Classification Search

CPC ..... G10L 15/20; G10L 21/0208
USPC ..... 704/233, 226
See application file for complete search history.

(56) References Cited

U.S. PATENT DOCUMENTS 5,583,968 A * 12/1996 Trompf ..... G10L 15/20 704/232
5,680,393 A * 10/1997 Bourmeyster et al. ..... 370/286
5,826,230 A * 10/1998 Reaves ..... G10L 25/78 704/233
6,427,134 B1 * 7/2002 Garner ..... G10L 25/78 379/399.01
6,502,067 B1 * 12/2002 Hegger et al. ..... 704/216
6,718,316 B1 * 4/2004 Higgins ..... G06K 9/0051 706/15

(Continued)

FOREIGN PATENT DOCUMENTS

JP 2011-002723 A 1/2011
JP 2012-114842 A 6/2012

OTHER PUBLICATIONS

Kim, H-I., and S-K. Park. "Voice activity detection algorithm using radial basis function network." Electronics Letters 40.22 (2004): 1454-1455.*

*Primary Examiner* — Jialong He
(74) *Attorney, Agent, or Firm* — Chip Law Group

(57) ABSTRACT

There is provided a signal processing device including a feature amount extraction unit configured to extract, from a frequency-domain signal obtained by frequency conversion on a voice signal, a feature amount of the frequency-domain signal, and a determination unit configured to determine, based on the extracted feature amount, presence or absence of noise in the voice signal within a predetermined section. The feature amount is composed of a plurality of elements. The plurality of elements contain an element defined based on a correlation value between a feature amount waveform which is a waveform according to the frequency-domain signal in the voice signal within the predetermined section and a feature amount waveform within another section sequential in time to the predetermined section.

15 Claims, 17 Drawing Sheets

(56) References Cited

U.S. PATENT DOCUMENTS

| | | | | |
|---|---|---|---|---|
| 7,852,950 | B2 * | 12/2010 | Sedarat | 375/260 |
| 7,860,718 | B2 * | 12/2010 | Lee | G10L 15/25 704/223 |
| 8,781,137 | B1 * | 7/2014 | Goodwin | H04R 3/005 381/94.1 |
| 8,788,265 | B2 * | 7/2014 | Laaksonen | G10L 25/78 704/200.1 |
| 8,949,120 | B1 * | 2/2015 | Every et al. | 704/226 |
| 2002/0126856 | A1 * | 9/2002 | Krasny et al. | 381/94.1 |
| 2004/0024596 | A1 * | 2/2004 | Carney et al. | 704/220 |
| 2005/0114128 | A1 * | 5/2005 | Hetherington et al. | 704/233 |
| 2005/0228660 | A1 * | 10/2005 | Schweng | 704/226 |
| 2008/0159559 | A1 * | 7/2008 | Akagi et al. | 381/92 |
| 2008/0310646 | A1 * | 12/2008 | Amada | 381/73.1 |
| 2010/0158269 | A1 * | 6/2010 | Zhang | 381/94.2 |
| 2011/0228951 | A1 * | 9/2011 | Sekiya et al. | 381/94.1 |
| 2012/0133784 | A1 * | 5/2012 | Kajimura | 348/207.99 |

* cited by examiner

FIG. 3

TABLE

| | THRESHOLD | DETERMINATION CONDITION |
|---|---|---|
| AMPLITUDE | 8000 | True IF GREATER |
| SUDDENNESS | 8 | True IF SMALLER |
| PERIODICITY | 0.90 | True IF GREATER |
| ⋮ | ⋮ | ⋮ |

| VECTOR OF FEATURE AMOUNT | DETERMINATION RESULT |
|---|---|
| 8523 | True |
| 9 | False |
| 0.95 | True |
| ⋮ | ⋮ |

NOISE REMOVAL DEVICE AND METHOD, AND PROGRAM

CROSS REFERENCE TO RELATED APPLICATIONS

This application claims the benefit of Japanese Priority Patent Application JP 2012-236313 filed Oct. 26, 2012, the entire contents of which are incorporated herein by reference.

BACKGROUND

The present technology relates to a signal processing device and method and a program, and specifically relates to a signal processing device and method and a program of enabling removal of noise occurring in recording voice in high accuracy.

From among apparatuses for recording voice (including moving pictures) are known a video camera, a digital camera with a function of capturing moving pictures, a smart phone, an IC recorder and the like. In operation of these apparatuses, sound occurring from the apparatus body sometimes contaminates in the recorded voice.

For example, zoom driving sound, autofocus driving sound, aperture stop driving sound and the like occur in capturing a moving picture. These sounds occur due to driving of components inside the apparatus and have various acoustic characteristics according to driving manners and control manners.

Moreover, a piezoelectric element deforming in response to applied voltage is often used for driving of lenses according to autofocusing and zooming in recent years. Driving sound due to the piezoelectric element sometimes has different characteristics from existing ones.

Noise caused by such driving sound is occasionally called sudden noise. The sudden noise contaminating in the recorded voice is exceedingly grating on the ears and expects a measure for lowering the sound, a measure for noise removal or the like.

Some measures against the sudden noise have been proposed.

For example, a technology is proposed for generating a combined voice signal from a voice signal which is in a period prior to timing when a drive signal is transmitted in response to the drive signal having been transmitted and combining the combined voice signal with a voice signal which is in a period posterior to the timing when the drive signal is transmitted (for example, Japanese Patent Laid-Open No. 2011-002723 which is hereinafter referred to as Patent Literature 1).

Moreover, a technology is also proposed for extracting a frequency component characteristic of driving of an optical element from output voice from a microphone within a certain period from a drive command, detecting a section where it has a certain level or more, and performing prediction and interpolation based on the voice before and after the section (for example, Japanese Patent Laid-Open No. 2012-114842 which is hereinafter referred to as Patent Literature 2). Thereby, driving noise along with driving of an imaging optical system can be removed in high accuracy.

SUMMARY

The technology of Patent Literature 1, however, does not consider delay from the transmission of the drive signal to the operation of the apparatus, time when the sound reaches the microphone from the driving sound source and the like.

Due to this, the noise reduction processing is performed even in a section of no driving noise, this sometimes causing deterioration of fidelity to the original sound.

Moreover, the technology of Patent Literature 2 is conducted to determine the noise removal section in focusing on the power in a high frequency band mainly not less than 10 kHz. In a practical image capturing environment, however, various kinds of sound are countlessly in the 10 kHz band other than kinds of the driving sound, this possibly causing false determination.

Furthermore, a piezoelectric element is used for driving lenses according to autofocusing and zooming in recent years in camera-functioning units built in electronic apparatuses such as a smart phone which save power and are small in height.

Although noise caused by driving sound due to such a piezoelectric element is sudden noise, it can often occur several times succeedingly in driving. It sometimes all the more gives uncomfortable impression when part of such sudden noise that succeedingly occurs is left not to be removed.

It is desirable to enable to remove noise occurring in recording voice in high accuracy.

According to an embodiment of the present technology, there is provided a signal processing device including a feature amount extraction unit configured to extract, from a frequency-domain signal obtained by frequency conversion on a voice signal, a feature amount of the frequency-domain signal, and a determination unit configured to determine, based on the extracted feature amount, presence or absence of noise in the voice signal within a predetermined section. The feature amount is composed of a plurality of elements, and the plurality of elements contain an element defined based on a correlation value between a feature amount waveform which is a waveform according to the frequency-domain signal in the voice signal within the predetermined section and a feature amount waveform within another section sequential in time to the predetermined section.

Each of the plurality of elements of the feature amount may be calculated based on the feature amount waveform within the predetermined section.

The feature amount waveform within the predetermined section may be a waveform of a one-dimensional signal obtained by extracting a signal intensity for a preset frequency band from the frequency-domain signal.

The plurality of elements of the feature amount may further contain a maximum value of an amplitude of the feature amount waveform or a value representing suddenness of the feature amount waveform.

The signal processing device may further include another feature amount extraction unit extracting a feature amount from the voice signal before the frequency conversion.

The determination unit may determine driving sound of a component driven based on electronic control as the noise, the device may further include a control signal supply unit configured to supply a control signal representing presence or absence of driving of the component to the feature amount extraction unit.

The signal processing device may further include a factor holding unit configured to hold a factor used for determination by the determination unit and beforehand obtained by learning.

The determination unit may determine driving sound of a component driven based on electronic control as the noise, the device further include a drive information supply unit configured to supply information representing a driving manner of the component to the factor holding unit, and the factor holding unit supplies the factor to the determination unit based on the information supplied from the drive information supply unit.

The determination unit may determine the presence or absence of the noise based on an operation result of product-sum operation multiplying the individual plurality of elements of the feature amount by the factor held in the factor holding unit.

The determination unit may determine the presence or absence of the noise based on a determination result obtained by threshold determination, based on the factor held in the factor holding unit, on the individual plurality of elements of the feature amount.

The signal processing device may further include a noise removal unit removing the noise within the predetermined section when the determination unit determines that the noise is present in the voice signal within the predetermined section.

The noise removal unit may extract a preset frequency band from the frequency-domain signal and performs processing of removing the noise only for the extracted frequency band.

The voice signal collected by a microphone may be inputted.

The voice signal beforehand recorded may be inputted.

According to an embodiment of the present technology, there is provided a signal processing method including, by a feature amount extraction unit, extracting, from a frequency-domain signal obtained by frequency conversion on a voice signal, a feature amount of the frequency-domain signal, and by a determination unit, determining, based on the extracted feature amount, presence or absence of noise in the voice signal within a predetermined section. The feature amount is composed of a plurality of elements, and the plurality of elements contain an element defined based on a correlation value between a feature amount waveform which is a waveform according to the frequency-domain signal in the voice signal within the predetermined section and a feature amount waveform within another section sequential in time to the predetermined section.

According to an embodiment of the present technology, there is provided a program for causing a computer to function as a signal processing device including a feature amount extraction unit configured to extract, from a frequency-domain signal obtained by frequency conversion on a voice signal, a feature amount of the frequency-domain signal, and a determination unit configured to determine, based on the extracted feature amount, presence or absence of noise in the voice signal within a predetermined section. The feature amount is composed of a plurality of elements, and the plurality of elements contain an element defined based on a correlation value between a feature amount waveform which is a waveform according to the frequency-domain signal in the voice signal within the predetermined section and a feature amount waveform within another section sequential in time to the predetermined section.

According to an embodiment of the present technology, by a feature amount extraction unit, a feature amount of the frequency-domain signal is extracted from a frequency-domain signal obtained by frequency conversion on a voice signal, and by a determination unit, presence or absence of noise in the voice signal within a predetermined section is determined based on the extracted feature amount. The feature amount is composed of a plurality of elements, and the plurality of elements contain an element defined based on a correlation value between a feature amount waveform which is a waveform according to the frequency-domain signal in the voice signal within the predetermined section and a feature amount waveform within another section sequential in time to the predetermined section.

According to the present technology, noise occurring in recording voice can be removed in high accuracy.

BRIEF DESCRIPTION OF THE DRAWINGS

FIG. 3 is a diagram for explaining an example of table determination;

DETAILED DESCRIPTION OF THE EMBODIMENT(S)

Figure 1:
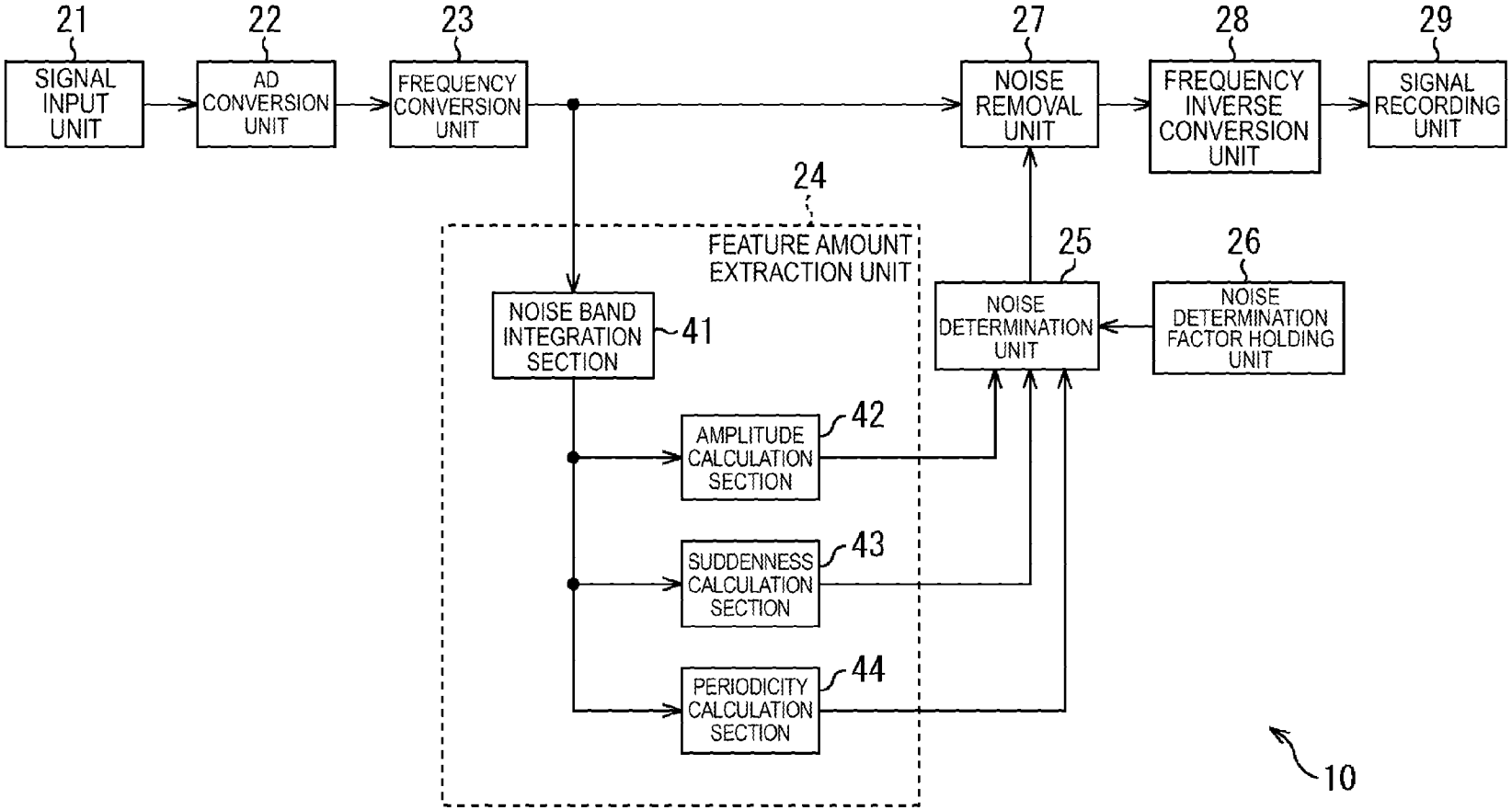
FIG. 1 is a block diagram illustrating an exemplary configuration of a signal processing device according to an embodiment of the present technology.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

FIG. 1 is a block diagram illustrating an exemplary configuration of a signal processing device according to an embodiment of the present technology. The signal processing device 10 illustrated in the figure is, for example, built in an electronic apparatus such as a digital camera and a smart phone having a camera-functioning unit.

The camera-functioning unit in the electronic apparatus can perform, for example, adjustment for zooming and autofocusing, which move lens positions, and aperture stops. For example, the lens is configured to be moved by a piezoelectric element which is provided as an actuator and driven.

The signal processing device 10 is configured, for example, to analyze a voice signal recorded in capturing a moving picture using a digital camera, smart phone or the like and to perform processing of reducing noise contained in the voice signal. The signal processing device 10 is configured to reduce, primarily as noise, driving sound such as zoom driving sound, autofocus driving sound and aperture stop driving sound which occurs in capturing a moving picture.

Figure 2:
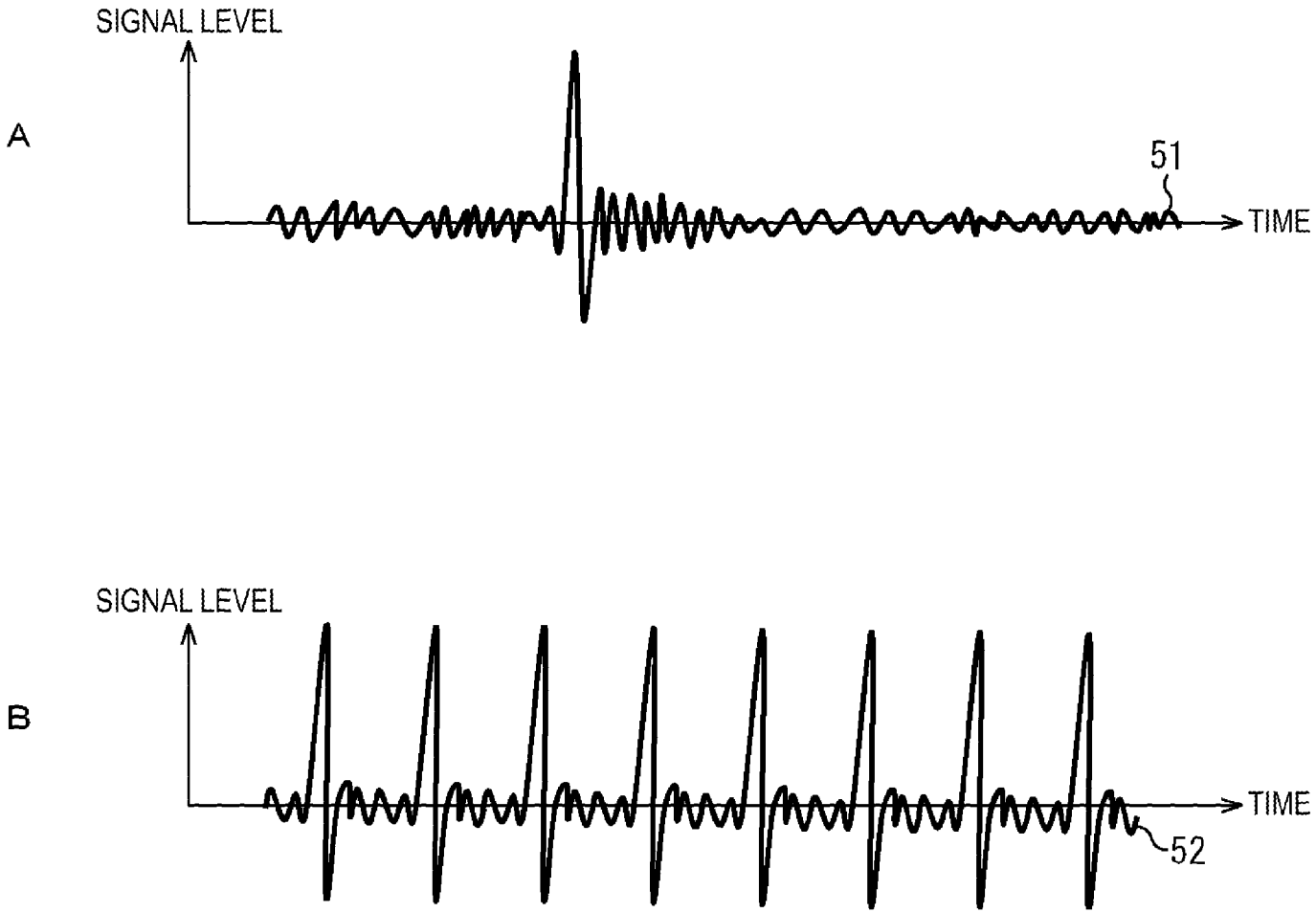
FIGS. 2A and 2B are diagrams for explaining driving sound.

FIGS. 2A and 2B are diagrams for explaining the driving sound such as zoom driving sound, autofocus driving sound and aperture stop driving sound.

FIG. 2A is a diagram illustrating an example of driving sound due to an existing actuator using a motor or the like. In the figure, the horizontal axis presents time and the vertical axis presents signal levels, and a line 51 represents a waveform of the noise. As illustrated in the figure, the amplitude of the line 51 protrudes in the vicinity of the center in the figure, repeating fine oscillation.

As above, when an existing actuator is driven, the signal level changes suddenly and the change in signal level causes the noise. Such noise is called sudden noise.

FIG. 2B is a diagram illustrating an example of driving sound due to an actuator using a piezoelectric element. In the figure, the horizontal axis presents time and the vertical axis presents signal levels, and a line 52 represents a waveform of the noise. As illustrated in the figure, on the line 52, portions whose amplitudes protrude appears repeatedly.

Although the noise caused by driving sound due to a piezoelectric element is sudden noise, it can often occur several times succeedingly in driving. It sometimes all the more gives uncomfortable impression when part of such sudden noise that succeedingly occurs is left not to be removed.

The signal processing device 10 is configured to be able surely to detect and reduce noise occurring several times succeedingly in driving, as above, although it is sudden noise.

In FIG. 1, a signal input unit 21 is configured, for example, of a microphone and configured to collect voice in the surroundings of the electronic apparatus to which the signal processing device 10 is attached.

The AD conversion unit 22 converts a signal from the voice thus collected by the signal input unit 21 into a digital signal to generate a digital voice signal.

A frequency conversion unit 23 converts the signal in the time domain into a signal in the frequency domain. The frequency conversion unit 23 performs, for example, fast Fourier transform (FFT) processing on the digital voice signal outputted from the AD conversion unit 22 to perform the conversion into the signal in the frequency domain.

At this stage, for example, the inputted digital voice signal undergoes frame partitioning for every set of 512 samples, is multiplied by a window function, and undergoes the FFT processing. In addition, for example, the frame partitioning is configured to be performed by shifting the section by every set of 256 samples step by step.

A feature amount extraction unit 24 extracts a plurality of feature amounts based on the signal in the frequency domain outputted from the frequency conversion unit 23. For the frames obtained by the partitioning in the FFT processing, the feature amount extraction unit 24 extracts feature amounts, for example, representing amplitude, suddenness, periodicity and the like for every plurality of frames (for example, 10 frames) which constitute a feature amount waveform mentioned later. In addition, a detailed configuration of the feature amount extraction unit 24 is described later.

A noise determination unit 25 is configured, for example, of a linear discriminant analysis device, a statistical discriminant analysis device using a neural network, and the like and determines whether or not the relevant frames are frames of noise based on the plurality of feature amounts outputted from the feature amount extraction unit 24. In addition, it is determined based on the feature amount waveform mentioned later whether or not they are frames of noise. It is determined collectively whether or not the plurality of frames (for example, 10 frames) which constitute the feature amount waveform are noise.

The noise determination unit 25 calculates the value of y using equation (1) with a variable as vector X ($x_1$, $x_2$, $x_3$, . . . ) composed of the individual plurality of feature amounts outputted from the feature amount extraction unit 24 as its elements. In equation (1), I denotes the total number of elements of vector X.

$$y = \sum_{i=1}^{I} w_i x_i \tag{1}$$

Factor $w_i$ in equation (1) is a weighting factor by which each feature amount is multiplied and hereinafter called a noise determination factor. The noise determination factors are learned, for example, using a plurality of samples of noise and non-noise beforehand acquired and the like and using an optimization method such as a steepest descent method and a Newton method.

Noise determination factor W ($w_1$, $w_2$, $w_3$, . . . ) is stored in a noise determination factor holding unit 26. When the noise determination unit 25 performs the operation of equation (1), noise determination factor W is supplied to the noise determination unit 25 from the noise determination factor holding unit 26.

Then, the noise determination unit 25 compares the value of y thus calculated according to the operation of equation (1) with a preset threshold. When the value of y is equal to or greater than the threshold, it is determined that the relevant plurality of frames are frames of noise, and when the value of y is smaller than the threshold, it is determined that the relevant plurality of frames are not frames of noise.

Or the noise determination unit 25 may determine whether or not the relevant plurality of frames are frames of noise based on table determination.

In this case, table determination, for example, using a table as illustrated in FIG. 3 is performed. The example of FIG. 3 presents a table used for threshold determination on the individual feature amounts extracted by the feature amount extraction unit 24, vector X of the feature amounts, and the determination results. In addition, the thresholds and determination conditions described in the table are supposed, for example, to be stored in the noise determination factor holding unit 26

When the number of "True" in the determination results is, for example, equal to or greater than a threshold, the noise determination unit 25 determines that the relevant plurality of frames are frames of noise, and when the number of "True" in the determination results is smaller than the threshold, it is determined that the relevant plurality of frames are not frames of noise.

Returning to FIG. 1, a noise removal unit 27 is configured to remove (reduce) noise by changing a frequency spectrum for the plurality of frames which are determined as noise by the noise determination unit 25. The noise removal unit 27 performs processing, for example, of substituting a frequency spectrum for adjacent frames for one for 4 frames in the frequency spectrum for the 10 frames which are determined as being frames of noise. In addition, details of the processing of the noise removal unit 27 are described later.

A frequency inverse conversion unit 28 performs transform into a signal in the time domain by performing inverse FFT processing on the signal in the frequency domain outputted from the noise removal unit. Thereby, a digital voice signal in which noise is reduced will have been obtained.

A signal recording unit 29 is configured to record the digital voice signal outputted from the frequency inverse conversion unit 28.

Next, a detailed configuration of the feature amount extraction unit 24 is described. In the example of FIG. 1, the feature amount extraction unit 24 is configured of a noise band integration section 41, an amplitude calculation section 42, a suddenness calculation section 43 and a periodicity calculation section 44.

The noise band integration section 41 accumulates the signal in the frequency domain outputted from the frequency conversion unit 23 for a predetermined number of frames. Then, the noise band integration section 41 picks out signals only in frequency bands in which noise relevant to the driving sound is included from the signal in the frequency domain thus accumulated to integrate them and to generate a one-dimensional signal.

Figure 4:
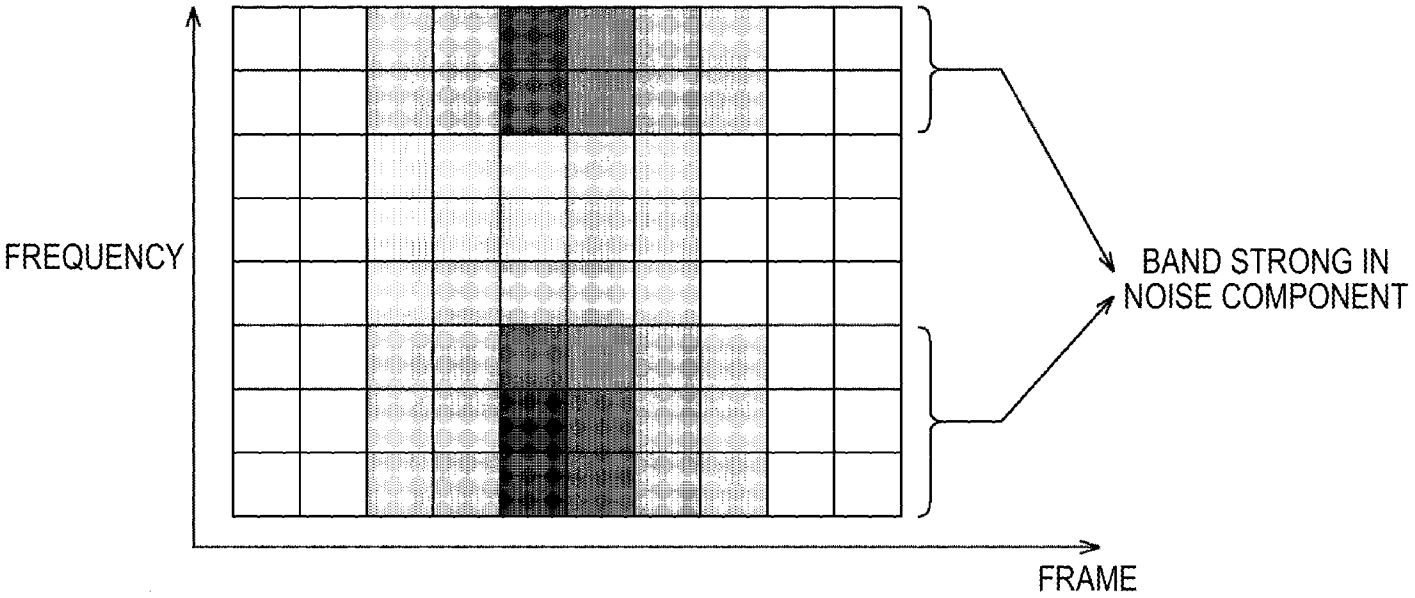
FIG. 4 is a diagram illustrating an example of a signal in the frequency domain outputted from a frequency conversion unit.

FIG. 4 is a diagram illustrating an example of the signal in the frequency domain outputted from the frequency conversion unit 23. In the figure, the horizontal axis presents frames and the vertical axis presents frequency bands. In this example, signal intensities for 10 frames and 8 frequency bands are presented.

In addition, in the example of FIG. 4, the signal intensity (power) for each frequency band in each frame is represented by a color depth. Namely, in FIG. 4, the signal intensity is high in the frequency band in a frame which band is displayed as a deep-colored rectangle and the signal intensity is low in the frequency band in a frame which band is displayed as a light-colored rectangle.

Frequency bands for which noise relevant to the driving sound is included are supposed to be known. In the example of FIG. 4, the frequency bands first and second from the top and the frequency bands first to third from the bottom are the frequency bands for which noise relevant to the driving sound is included. The noise band integration section 41 acquires the signal intensities for these frequency bands.

Figure 5:
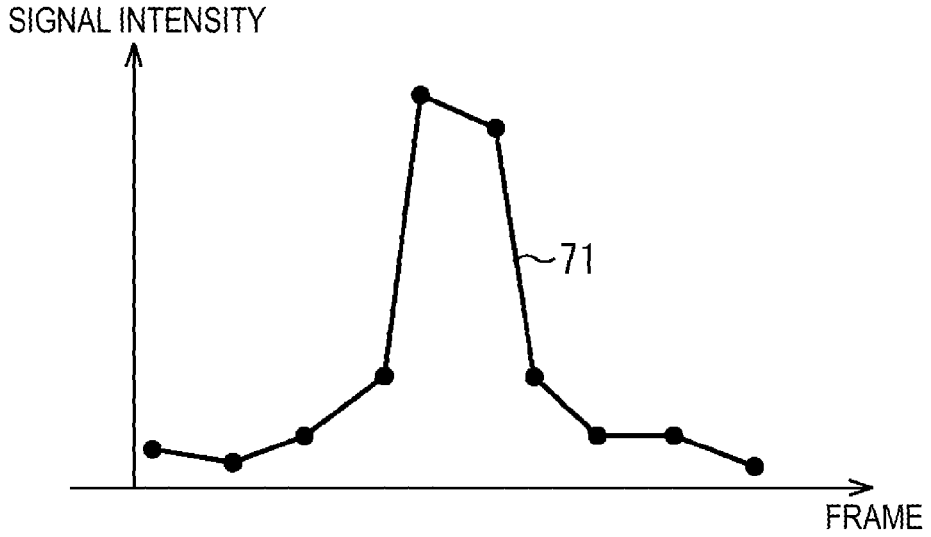
FIG. 5 is a diagram illustrating an example of a feature amount waveform.

Then, the noise band integration section 41 calculates the average of the plurality of signal intensities thus acquired (five ones in the example of FIG. 4) for every frame. Thereby, a one-dimensional signal as illustrated in FIG. 5 is generated. FIG. 5 is a diagram illustrating an example of a signal generated by the noise band integration section 41. In the figure, the horizontal axis presents frames and the vertical axis presents signal intensities.

Namely, the average of signal intensities for the above-mentioned five frequency bands in the first frame, the average of signal intensities for the above-mentioned five frequency bands in the second frame, . . . are plotted and connected successively, and thereby, a waveform 71 in FIG. 5 is formed. Namely, the 10 plot points on the waveform 71 illustrated in FIG. 5 correspond to the individual frames.

The waveform 71 illustrated in FIG. 5 is used for calculation of individual feature amounts by the amplitude calculation section 42, suddenness calculation section 43 and periodicity calculation section 44. The waveform of the signal generated by the noise band integration section 41 as illustrated in FIG. 5 is hereinafter called a feature amount waveform.

In the example of FIG. 5, the feature amount waveform is supposed to have a length in time for 10 frames and such a length of the feature amount waveform in time is supposed to be preset. For example, an appropriate length in time according to a kind of the driving sound is supposed to be known and a feature amount waveform with a frame number corresponding to the known length in time is configured to be generated by the noise band integration section 41.

Each of the amplitude calculation section 42, suddenness calculation section 43 and periodicity calculation section 44 calculates a feature amount(s) based on the waveform of the one-dimensional signal generated by the noise band integration section 41 (that is, feature amount waveform). The feature amounts calculated herein correspond to vector X ($x_1$, $x_2$, $x_3$, $x_4$) which is a variable used for the operation of equation (1). In addition, in the configuration of FIG. 1, each of the amplitude calculation section 42 and suddenness calculation section 43 calculates one feature amount and the periodicity calculation section 44 calculates two feature amounts, the total number I of the elements of vector X being 4.

As mentioned above, although the noise caused by the driving sound due to a piezoelectric element is sudden noise, it can often occur several times succeedingly in driving. It sometimes all the more gives uncomfortable impression when part of such sudden noise that succeedingly occurs is left not to be removed. Due to this, the signal processing device 10 to which the present technology is applied calculates feature amounts so as to be able surely to detect sudden noise occurring several times succeedingly.

Figure 6:
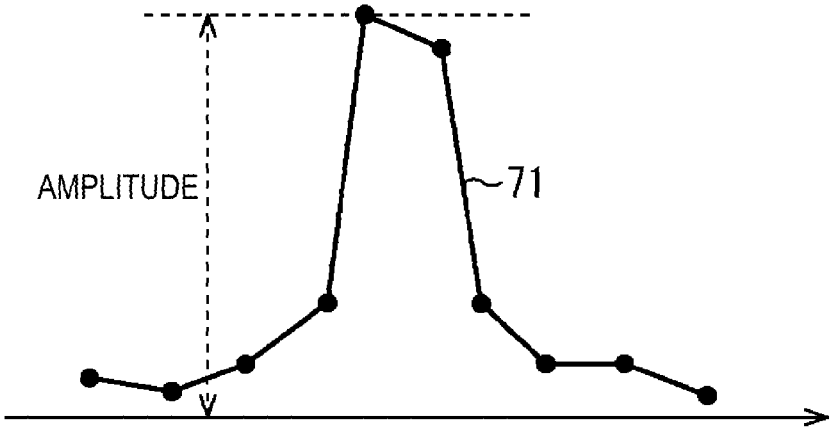
FIG. 6 is a diagram for explaining calculation of an amplitude value.

The amplitude calculation section 42 calculates the maximum value of the amplitude of the feature amount waveform 71. For example, as illustrated in FIG. 6, the maximum value of the amplitude of the waveform 71 is calculated as an amplitude value.

The amplitude value thus calculated by the amplitude calculation section 42 is, for example, the first element of vector X which is a variable used for the operation of equation (1).

Figure 7:
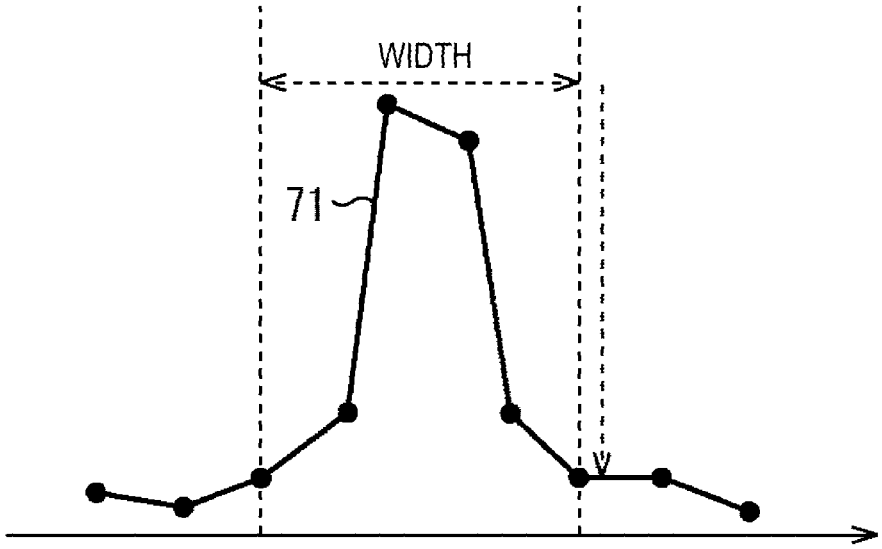
FIG. 7 is a diagram for explaining calculation of a suddenness value.

The suddenness calculation section 43 calculates a value representing suddenness in the feature amount waveform 71 as a suddenness value. Herein, the suddenness value is supposed to represent how the feature amount waveform 71 is steep. For example, as illustrated in FIG. 7, a width of the feature amount waveform 71 is calculated as the suddenness value. In addition, in the example of FIG. 7, time between frames in which the values of signal intensities (vertical axis) are ¼ of the maximum value of the amplitude is the suddenness value, in the feature amount waveform 71.

Or the ratio between the maximum value of the amplitude of the feature amount waveform 71 and a width of the feature amount waveform 71 may be configured to be calculated as the suddenness value.

The suddenness value thus calculated by the suddenness calculation section 43 is, for example, the second element of vector X which is the variable used for the operation of equation (1).

The periodicity calculation section 44 calculates a value representing the degree of succeeding occurrence of the feature amount waveform of sudden noise as a periodicity value. The periodicity value is, for example, a correlation value between the feature amount waveform currently processed and a past feature amount waveform sequential in time to the feature amount waveform.

Figure 8:
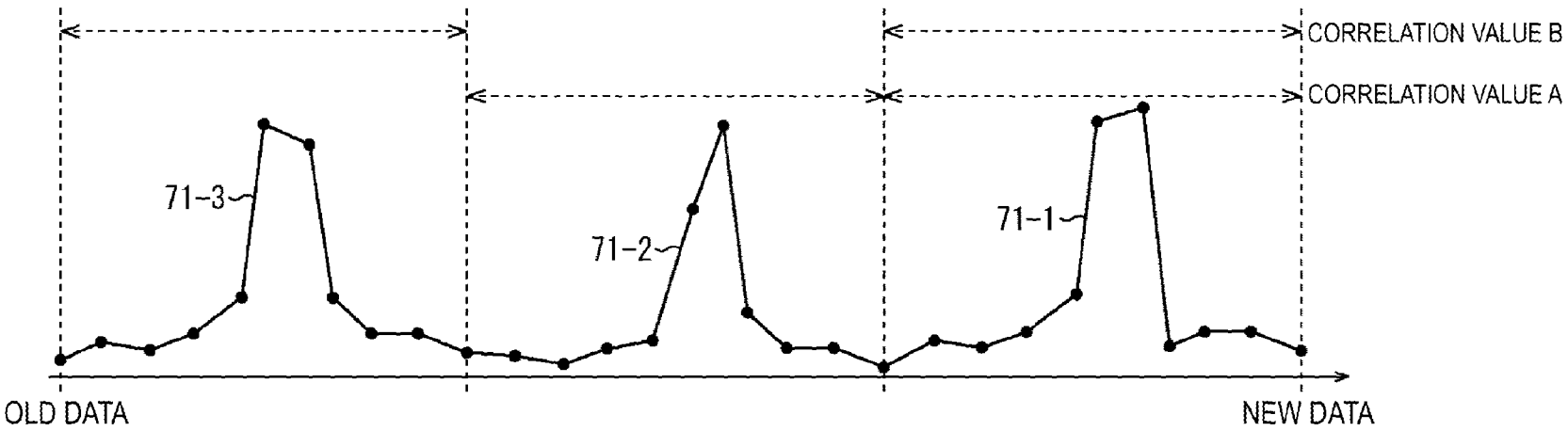
FIG. 8 is a diagram for explaining calculation of a periodicity value.

FIG. 8 is a diagram for explaining a way of calculation of the periodicity value. In the example of the figure, waveforms of a one-dimensional signal for 30 frames which are sequential in time are illustrated. Namely, a feature amount waveform 71-3 corresponding to the oldest 10 frames (first frame to tenth frame), a feature amount waveform 71-2 corresponding to the eleventh frame to the twentieth frame and a feature amount waveform 71-1 corresponding to the twenty first frame to the thirtieth frame are illustrated.

In addition, the periodicity calculation section 44 is supposed to have a buffer holding feature amount waveforms and the feature amount waveform 71-2 and feature amount waveform 71-3 are held in the buffer.

The periodicity calculation section 44 calculates a correlation value A which is a correlation value between the feature amount waveform 71-1 and feature amount waveform 71-2 and a correlation value B which is a correlation value between the feature amount waveform 71-1 and feature amount waveform 71-3. Then, each of the correlation value A and correlation value B is outputted as the periodicity value.

The periodicity values thus calculated by the periodicity calculation section 44 (correlation value A and correlation value B) are, for example, the third element and fourth element of vector X which is a variable used for the operation of equation (1).

In the example, the periodicity calculation section 44 calculating two correlation values is described as one example, whereas more correlation values may be calculated, for example, when the capacity of the buffer is large enough.

The feature amount extraction unit 24 thus calculates the feature amounts to output to the noise determination unit 25.

Next, details of the processing of the noise removal unit 27 are described. As mentioned above, the noise removal unit 27 is configured to remove (reduce) noise by changing a frequency spectrum for a plurality of frames (for example, 10 frames) which are determined as noise by the noise determination unit 25.

The noise removal unit 27 picks out, from the signal in the frequency domain outputted from the frequency conversion unit 23, ones only in the frequency bands in which noise relevant to the driving sound is included, and changes the frequency spectrum in the frames which are determined as noise.

Figure 9:
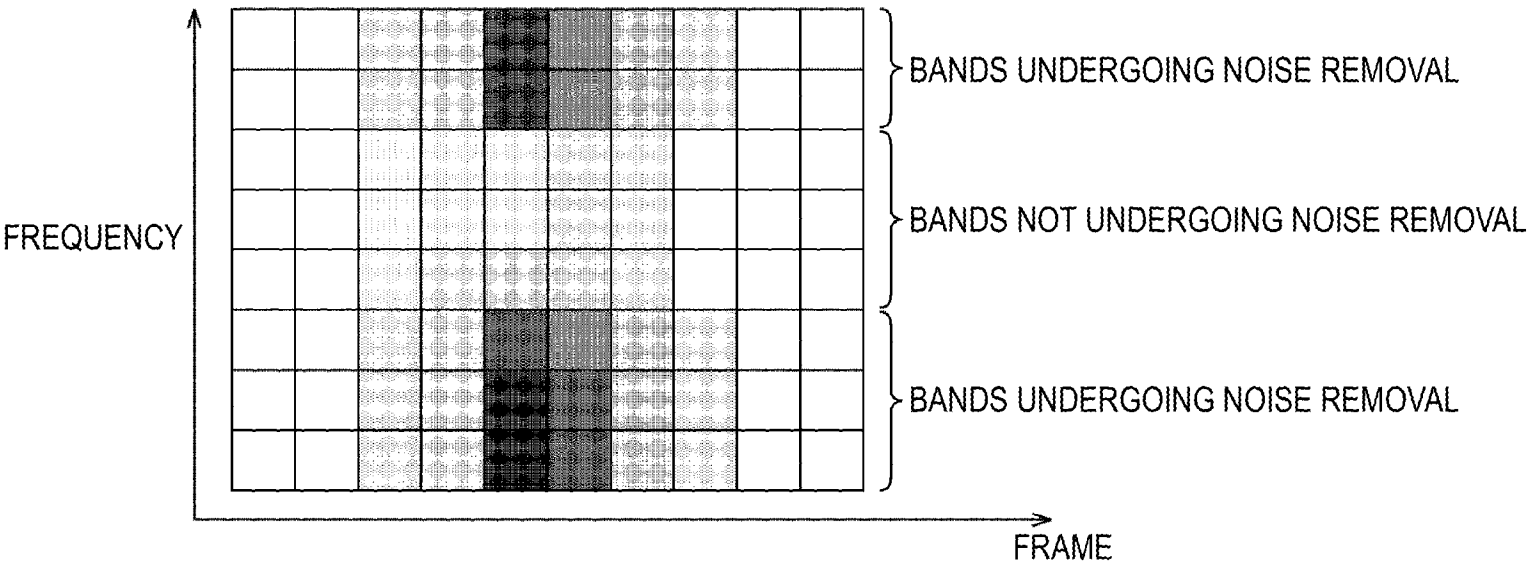
FIG. 9 is a diagram for explaining details of processing by a noise removal unit.

FIG. 9 is a diagram illustrating an example of frequency bands for which noise is removed by the noise removal unit 27 and frequency bands for which noise removal is not performed. In the figure, the horizontal axis presents frames and the vertical axis presents frequency bands. In this example, signal intensities for 10 frames and 8 frequency bands are presented.

In addition, in FIG. 9 similarly to FIG. 4, the signal intensity (power) for each frequency band in each frame is represented by a color depth. Namely, in FIG. 9, the signal intensity is high in the frequency band in a frame which band is displayed as a deep-colored rectangle and the signal intensity is low in the frequency band in a frame which band is displayed as a light-colored rectangle.

The noise removal unit 27 performs the picking out only for frequency bands which are preset and for which noise relevant to the driving sound is included, and changes frequency spectra in the frames in which noise is determined. In the example of FIG. 9, the frequency bands first and second from the top and the frequency bands first to third from the bottom are the frequency bands for which noise relevant to the driving sound is included. For these frequency bands, the noise removal unit 27 removes the noise. On the other hand, for the frequency bands third to fifth from the top, the noise removal unit 27 does not perform removal of noise.

Figure 10:
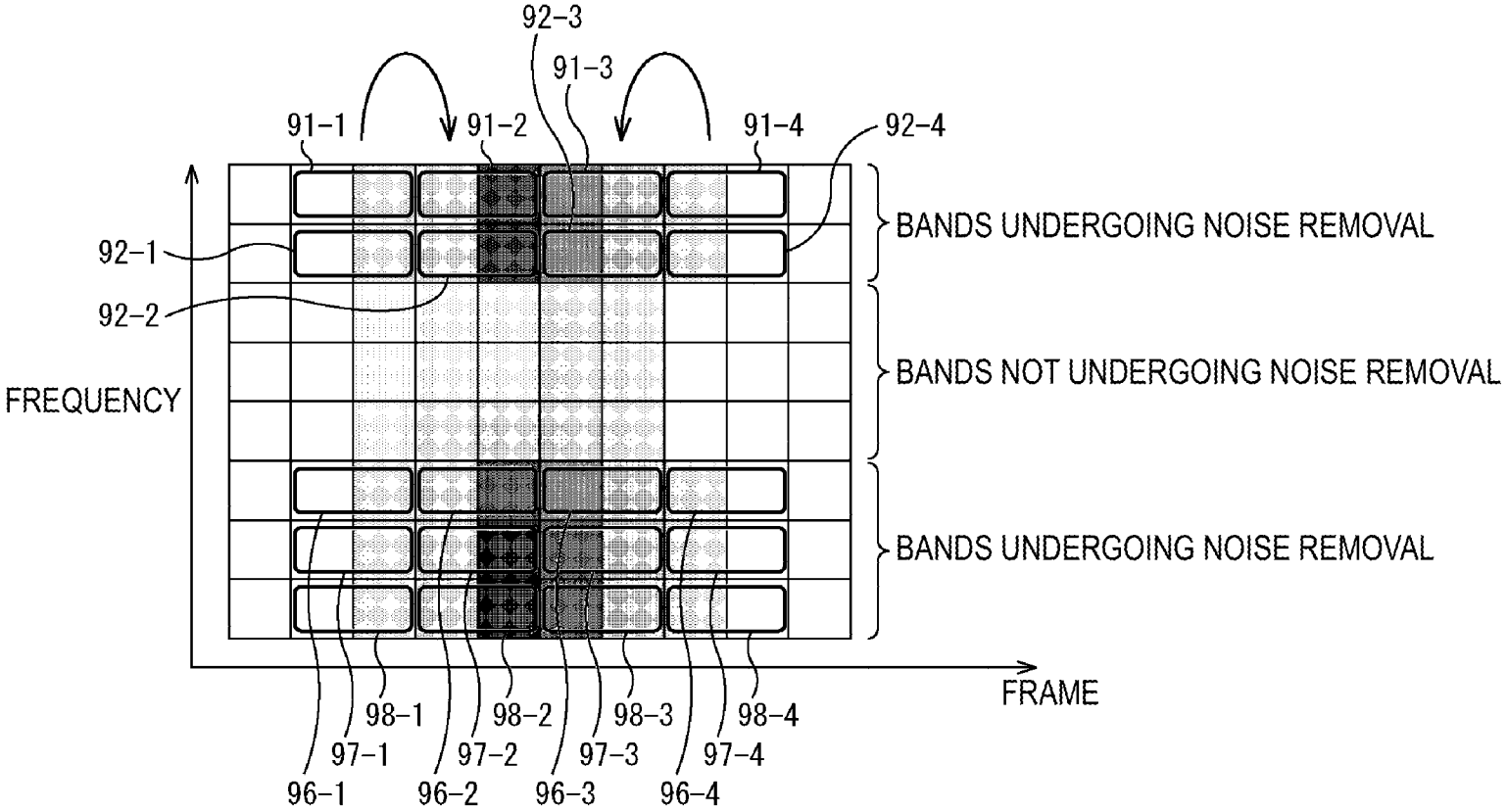
FIG. 10 is a diagram for explaining details of processing by the noise removal unit.

FIG. 10 is a diagram for explaining an example of a specific way of removal of noise. In the figure, the horizontal axis presents frames and the vertical axis presents frequency bands. In this example, signal intensities for 10 frames and 8 frequency bands are presented. Moreover, in FIG. 10, the signal intensity (power) for each frequency band in each frame is represented by a color depth.

In case of the example of FIG. 10, the frequency band first from the top is partitioned into region 91-1 to region 91-4 and the frequency band second from the top is partitioned into region 92-1 to region 92-4. Similarly, the frequency bands sixth to eighth from the top are partitioned into region 96-1 to region 98-4.

The noise removal unit 27 replaces the signal intensity of the region 91-2 with the signal intensity of the region 91-1 and replaces the signal intensity of the region 91-3 with the signal intensity of the region 91-4. The similar replacement is also performed on the region 92-1 to region 92-4 and performed on the region 96-1 to region 98-4.

Namely, for the frames high in signal intensity, replacement with the adjacent frames is performed. Thereby, the signal intensities are reduced, and thus, the noise is removed.

Or the noise removal unit 27 may replace the signal intensity of the region 91-2 multiplied by a predetermined factor (for example, 0.9) with the signal intensity of the region 91-1 and replace the signal intensity of the region 91-3 multiplied by the predetermined factor with the signal intensity of the region 91-4. The similar replacement may also be performed on the region 92-1 to region 92-4 and performed on the region 96-1 to region 98-4.

Figure 11:
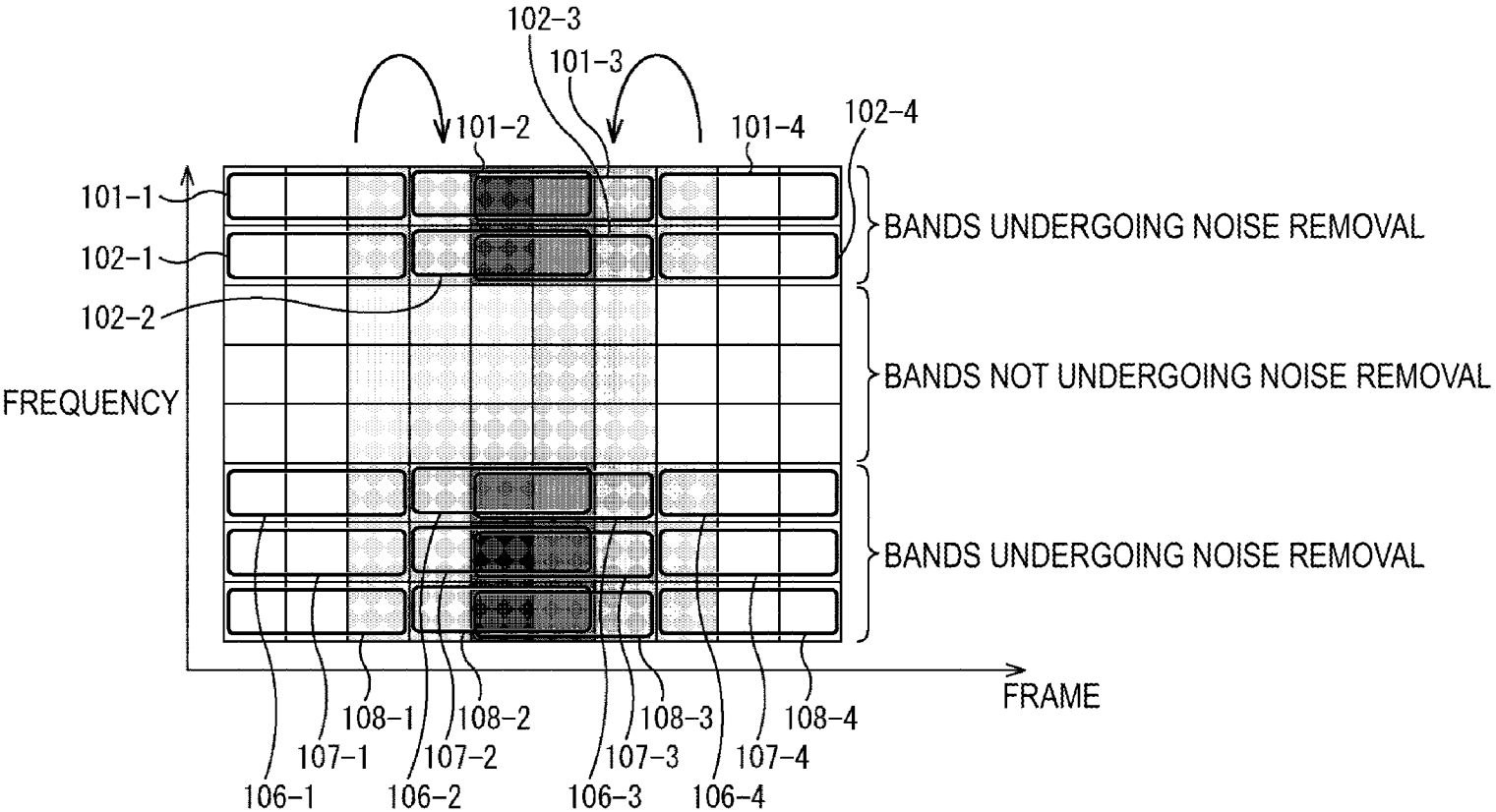
FIG. 11 is a diagram for explaining details of processing by the noise removal unit.

FIG. 11 is a diagram for explaining another example of a specific way of removal of noise. In the figure, the horizontal axis presents frames and the vertical axis presents frequency bands. In this example, signal intensities for 10 frames and 8 frequency bands are presented. Moreover, in FIG. 11, the signal intensity (power) for each frequency band in each frame is represented by a color depth.

In case of the example in FIG. 11, the frequency band first from the top is partitioned into region 101-1 to region 101-4 and the frequency band second from the top is partitioned into region 102-1 to region 102-4. Similarly, the frequency bands sixth to eighth from the top are partitioned into region 106-1 to region 108-4.

The noise removal unit 27 replaces the signal intensity of the region 101-2 with the signal intensity of the region 101-1 and replaces the signal intensity of the region 101-3 with the signal intensity of the region 101-4. At this stage, the region 101-3 and region 101-4 overlap with two frames. For the signal intensities in the overlapping frames, for example, the averages are set. The similar processing is also performed on the region 92-1 to region 92-4 and performed on the region 96-1 to region 98-4.

As above, the processing by the noise removal unit 27 is performed.

Figure 12:
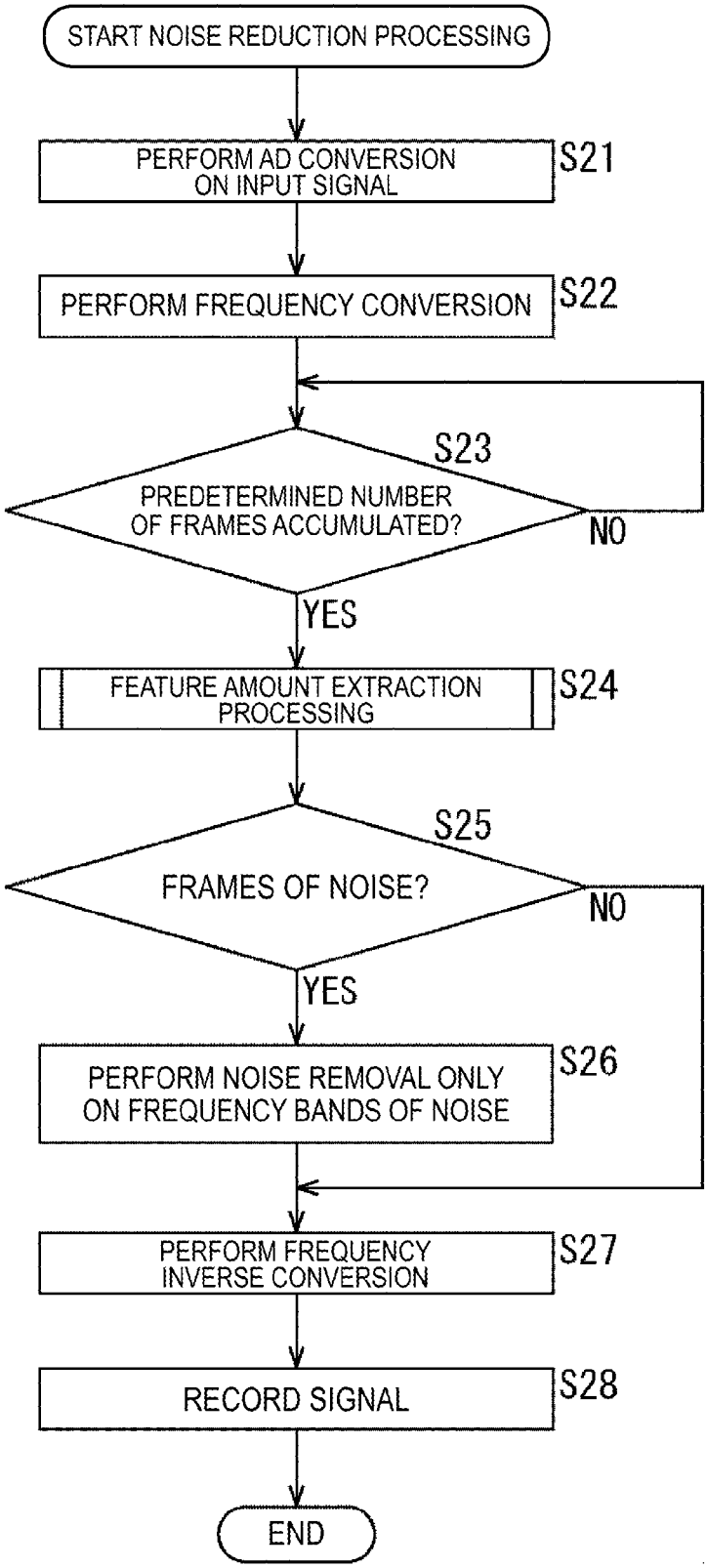
FIG. 12 is a flowchart for explaining an example of noise reduction processing.

Next, referring to a flowchart in FIG. 12, an example of noise reduction processing by the signal processing device 10 in FIG. 1 is described.

In step S21, the AD conversion unit 22 converts a signal (input signal) of voice collected by the signal input unit 21 into a digital signal. Thereby, a digital voice signal is generated.

In step S22, the frequency conversion unit 23 performs fast Fourier transform (FFT) processing on the digital voice signal generated in the process of step S21 to perform conversion into a signal in the frequency domain.

At this stage, for example, the inputted digital voice signal undergoes frame partitioning for every set of 512 samples, is multiplied by a window function and undergoes the FFT processing. In addition, for example, the frame partitioning is configured to be performed by shifting the section by set of every 256 samples step by step.

In step S23, it is determined whether or not the signals in the frequency domain in the process of step S22 have been accumulated for a predetermined number of frames, waiting until it is determined that they have been accumulated for the predetermined number of frames.

For example, when the signals in the frequency domain are accumulated for 10 frames, it is determined that they have been accumulated for the predetermined number of frames in step S23 and the process is put forward to step S24.

In step S24, the feature amount extraction unit 24 performs feature amount extraction processing mentioned later in reference to FIG. 13. Thereby, for example, feature amounts representing amplitude, suddenness, periodicity and the like are extracted.

In step S25, the noise determination unit 25 determines whether or not the relevant frames are frames of noise, based on the feature amounts obtained in the process of step S24. In addition, it is determined based on a feature amount waveform whether or not they are frames of noise. It is determined collectively whether or not the plurality of frames (for example, 10 frames) which constitute the feature amount waveform are noise.

At this stage, the noise determination unit 25 calculates the value of y using equation (1), mentioned above, with a variable as vector X ($x_1$, $x_2$, $x_3$, . . . ) composed of the individual plurality of feature amounts outputted from the feature amount extraction unit 24 as its elements and determines the affirmative or negative of noise. Or it may determine based on the table determination as mentioned above in reference to FIG. 3 whether or not the relevant plurality of frames are frames of noise.

In step S25, when it is determined that the relevant plurality of frames are frames of noise, the process is put forward to step S26.

In step S26, the noise removal unit 27 removes noise only in frequency bands of noise for the plurality of frames which are determined to include noise by the noise determination unit 25. At this stage, the noise is removed in a manner, for example, described above in reference to FIG. 10 or FIG. 11.

On the other hand, in step S25, when it is determined that the relevant plurality of frames are not frames of noise, the process in step S26 is skipped.

In step S27, the frequency inverse conversion unit 28 performs transform into a signal in the time domain (frequency inverse conversion) by performing inverse FFT processing on the signal in the frequency domain outputted from the noise removal unit. Thereby, a digital voice signal in which noise is reduced will have been obtained.

In step S28, the signal recording unit 29 records the digital voice signal outputted from the frequency inverse conversion unit 28.

Thus, the noise reduction processing is performed.

Figure 13:
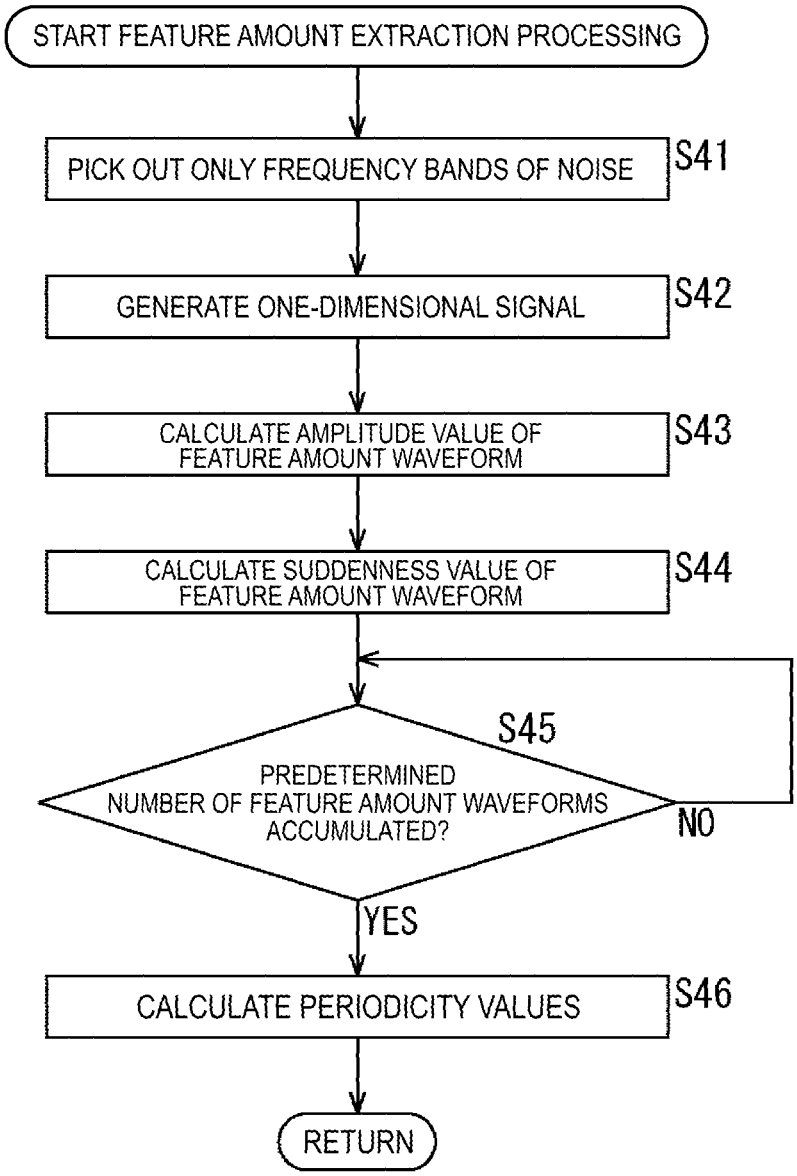
FIG. 13 is a flowchart for explaining an example of feature amount extraction processing.

Next, referring to a flowchart in FIG. 13, a detailed example of the feature amount extraction processing in step S24 of FIG. 12 is described.

In step S41, the noise band integration section 41 picks out only the frequency bands of noise. Namely, as mentioned above in reference to FIG. 4, the noise band integration section 41 acquires signal intensities, for example, for the frequency bands first and second from the top and the frequency bands first to third from the bottom.

In step S42, the noise band integration section 41 generates a one-dimensional signal. Namely, the average of the plurality of signal intensities acquired in step S41 are calculated for every one frame to generate the one-dimensional signal as illustrated in FIG. 5.

In step S43, the amplitude calculation section 42 calculates an amplitude value of the feature amount waveform obtained in the process of step S42. At this stage, the amplitude value is calculated, for example, as mentioned above in reference to FIG. 6.

In step S44, the suddenness calculation section 43 calculates a suddenness value of the feature amount waveform obtained in the process of step S42. At this stage, the suddenness value is calculated, for example, as mentioned above in reference to FIG. 7.

In step S45, the periodicity calculation section 44 determines whether or not a plurality of feature amount waveforms sequential in time are held in the buffer and waits until it is determined that the plurality of feature amount waveforms are held in the buffer. For example, when the feature amount waveform 71-3 and feature amount waveform 71-2 in FIG. 8 are held in the buffer, in step S45, it is determined that the plurality of feature amount waveform sequential in time are held in the buffer.

In step S45, when it is determined that the plurality of feature amount waveform sequential in time are held in the buffer, the process is put forward to step S46.

The periodicity calculation section 44 calculates the periodicity value. At this stage, for example, as mentioned above in reference to FIG. 8, the correlation values (correlation value A and correlation value B) between the feature amount waveform currently processed (feature amount waveform 71-1) and the past feature amount waveforms sequential in time (feature amount waveform 71-3 and feature amount waveform 71-2).

Thus, the feature amount extraction processing is performed.

According to the present technology, since the feature amount extraction unit 24 picks out only frequency bands of noise to generate a feature amount waveform and to calculate feature amounts, only driving sounds according to zooming, autofocusing, aperture stops and the like can be accurately detected and removed even in various environmental sounds accompanying them.

Moreover, since the periodicity calculation section 44 calculates periodicity values and is configured to determine whether or not noise is present based on feature amounts containing a periodicity value, detection of sudden noise with continuity is excellent. Accordingly, for example, even when a piezoelectric element is used for driving of lenses according to autofocusing and zooming, only the driving sound can be accurately detected.

Moreover, a piezoelectric element deforming in response to applied voltage is often used for driving of lenses according to autofocusing and zooming in recent years. Driving sound due to the piezoelectric element sometimes has different characteristics from existing ones.

Although noise caused by driving sound due to such a piezoelectric element is sudden noise, it can often occur several times succeedingly in driving. It sometimes all the more gives uncomfortable impression when part of such sudden noise that succeedingly occurs is left not to be removed.

According to the present technology, since driving sound due to a piezoelectric element can be accurately detected and removed, noise occurring in recording voice can be removed in high accuracy.

Figure 14:
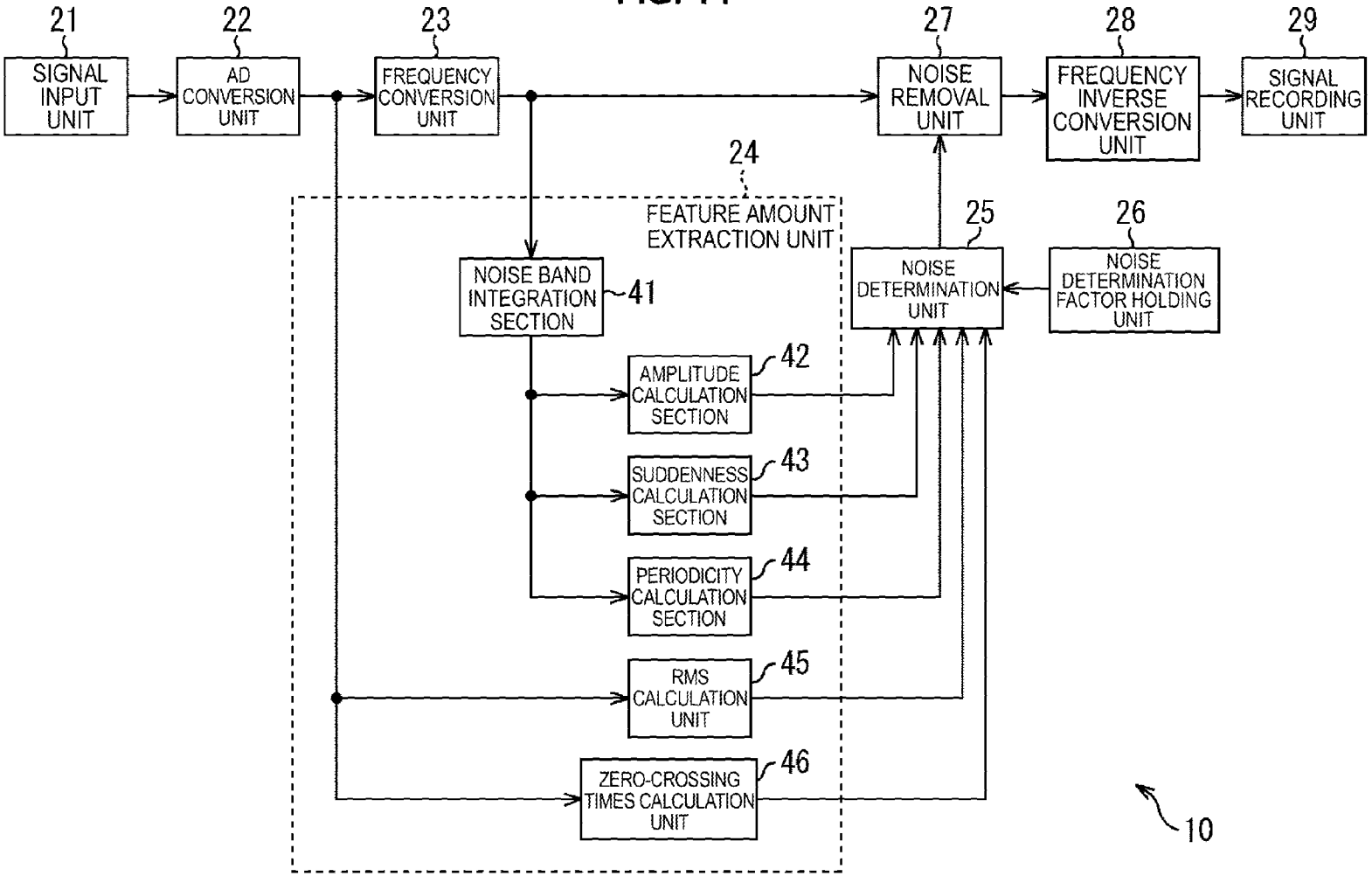
FIG. 14 is a block diagram illustrating another exemplary configuration of a signal processing device according to an embodiment of the present technology.

FIG. 14 is a block diagram illustrating another exemplary configuration of the signal processing device according to the embodiment of the present technology.

In the example of the figure, different from the case in FIG. 1, an RMS calculation unit 45 and a zero-crossing times calculation unit 46 are provided in the feature amount extraction unit 24 of the signal processing device 10. In the case of the configuration in FIG. 14, the digital voice signal outputted from the AD conversion unit is supplied to the RMS calculation unit 45 and zero-crossing times calculation unit 46.

The RMS calculation unit 45 calculates an RMS (Root Mean Square) value for 512 samples of the digital voice signal. The feature amounts containing the RMS value obtained from the digital voice signal enable to obtain information of the whole signal as well as the frequency bands of noise, improving the accuracy of the noise determination.

The RMS value calculated by the RMS calculation unit 45 is called, for example, the fifth element of vector X which is a variable used for the operation of equation (1).

In addition, the RMS value may be configured to be calculated for each of 2 frames, 3 frames or more frames where 512 samples of the digital voice signal correspond to one frame. Or the difference between the RMS values for frames sequential in time may be the feature amount outputted from the RMS calculation unit 45.

The zero-crossing times calculation unit 46 calculates the number of zero-crossing times for 512 samples of the digital voice signal. The feature amounts containing the number of zero-crossing times obtained from the digital voice signal enable, for example, also to take account of low-frequency components caused by oscillation.

In an electronic apparatus such as a digital camera and a smart phone, since the noise source such as a piezoelectric element is close to the microphone, the oscillation is also transmitted to the microphone along with noise occurring. Due to this, such oscillation along with noise occurring sometimes contaminates to the signal mainly as a low-frequency band component, being recorded. The noise determination performed based on the feature amount outputted from the zero-crossing times calculation unit 46 enables to determine noise including a low-frequency component caused by the oscillation.

The number of zero-crossing times calculated by the zero-crossing times calculation unit 46 is called, for example, the sixth element of vector X which is a variable used for the operation of equation (1).

The configuration of the other portions in FIG. 14 is similar to that in the case mentioned above in reference to FIG. 1 and their detailed description is omitted.

The signal processing device to which the present technology is applied may be configured as above.

Figure 15:
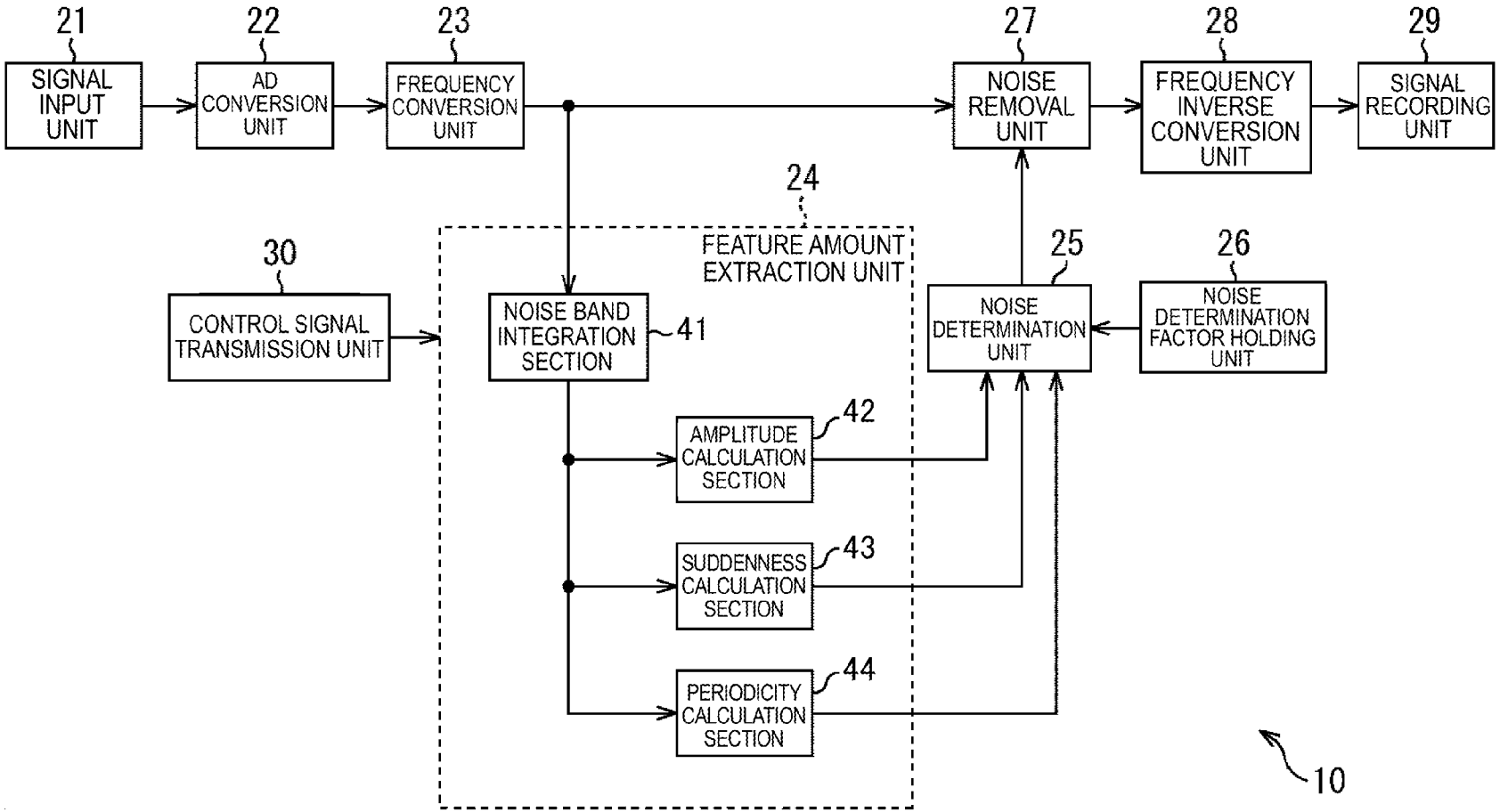
FIG. 15 is a block diagram illustrating still another exemplary configuration of a signal processing device according to an embodiment of the present technology.

FIG. 15 is a block diagram illustrating still another exemplary configuration of the signal processing device according to the embodiment of the present technology.

In the example of the figure, different from the case in FIG. 1, a control signal transmission unit 30 is provided in the signal processing device 10.

The control signal transmission unit 30 is connected, for example, to the controller of the electronic apparatus such as a digital camera and a smart phone and is configured to acquire information according to driving of the individual portions along with zooming, autofocusing, aperture stops and the like.

In the case of the configuration in FIG. 15, the control signal transmission unit 30 supplies a control signal representing the presence or absence of driving of an actuator, for example, constituted of a piezoelectric element and the like to the feature amount extraction unit 24. Then, only when the control signal representing driving of the actuator, for example, constituted of a piezoelectric element and the like is transmitted, the feature amount extraction unit 24 performs the feature amount extraction processing.

By doing so, when the actuator, for example, constituted of a piezoelectric element is not driven, noise does not occur. Therefore, processing according to the feature amount extraction is suspended meantime, and thus, processing load can be reduced. Moreover, a possibility of false determination in the noise determination unit 25 can be made low, this enabling to record voice in high quality.

The configuration of the other portions in FIG. 15 is similar to that in the case mentioned above in reference to FIG. 1 and their detailed description is omitted.

The signal processing device to which the present technology is applied may be configured as above.

Figure 16:
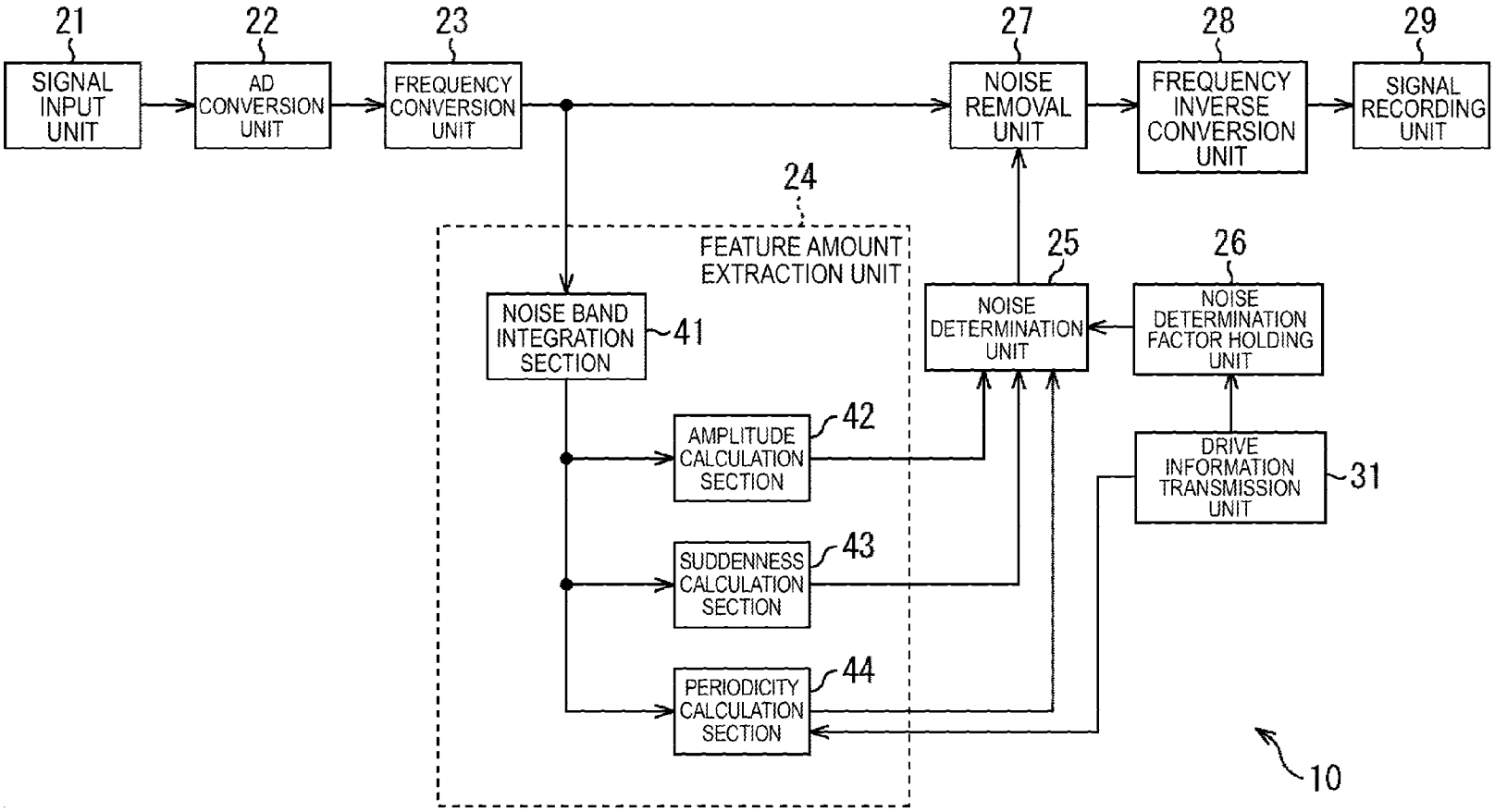
FIG. 16 is a block diagram illustrating still another exemplary configuration of a signal processing device according to an embodiment of the present technology.

FIG. 16 is a block diagram illustrating still another exemplary configuration of the signal processing device according to the embodiment of the present technology.

In the example of the figure, different from the case in FIG. 1, a drive information transmission unit 31 is provided in the signal processing device 10.

The drive information transmission unit 31 is connected, for example, to the controller of the electronic apparatus such as a digital camera and a smart phone and is configured to acquire information according to driving the individual portions along with zooming, autofocusing, aperture stops and the like.

In the case of the configuration in FIG. 16, the drive information transmission unit 31 supplies information for specifying a portion or element which is driven to the noise determination factor holding unit 26. Moreover, in the case of configuration in FIG. 16, the noise determination factor holding unit 26 holds factors different according to the portion or element which is driven.

For example, driving of the actuator according to the autofocusing and driving of the actuator according to the aperture stop have different characteristics of noise from each other. The noise determination factor holding unit 26 holds the noise determination factors most suitable for each and switches the factors according to the portion or element which is driven, enabling to improve the determination accuracy of the noise determination unit 25.

Furthermore, in the case of the configuration in FIG. 16, the drive information transmission unit 31 may supply information for specifying a mode of driving of the individual portions along with zooming, autofocusing, aperture stops and the like to the periodicity calculation section 44.

In this case, the periodicity calculation section 44 changes a way of operation of the correlation values according to the mode of driving.

For example, some digital cameras can switch a high-speed mode and a low-speed mode in autofocusing. For example, periodicity of noise in driving the actuator for moving the lens quickly in the high-speed mode and periodicity of noise in driving the actuator for moving the lens slowly in the low-speed mode are different from each other.

For example, the periodicity calculation section 44 which is in the high-speed mode calculates correlation between the feature amount waveform 71-1 and feature amount waveform 71-2 in FIG. 8 and that in the low-speed mode calculates correlation between the feature amount waveform 71-1 and feature amount waveform 71-3. By doing so, in case of each of the different modes, the feature amounts most suitable for the noise determination can be obtained.

The configuration of the other portions in FIG. 16 is similar to that in the case mentioned above in reference to FIG. 1 and their detailed description is omitted.

The signal processing device to which the present technology is applied may be configured as above.

Figure 17:
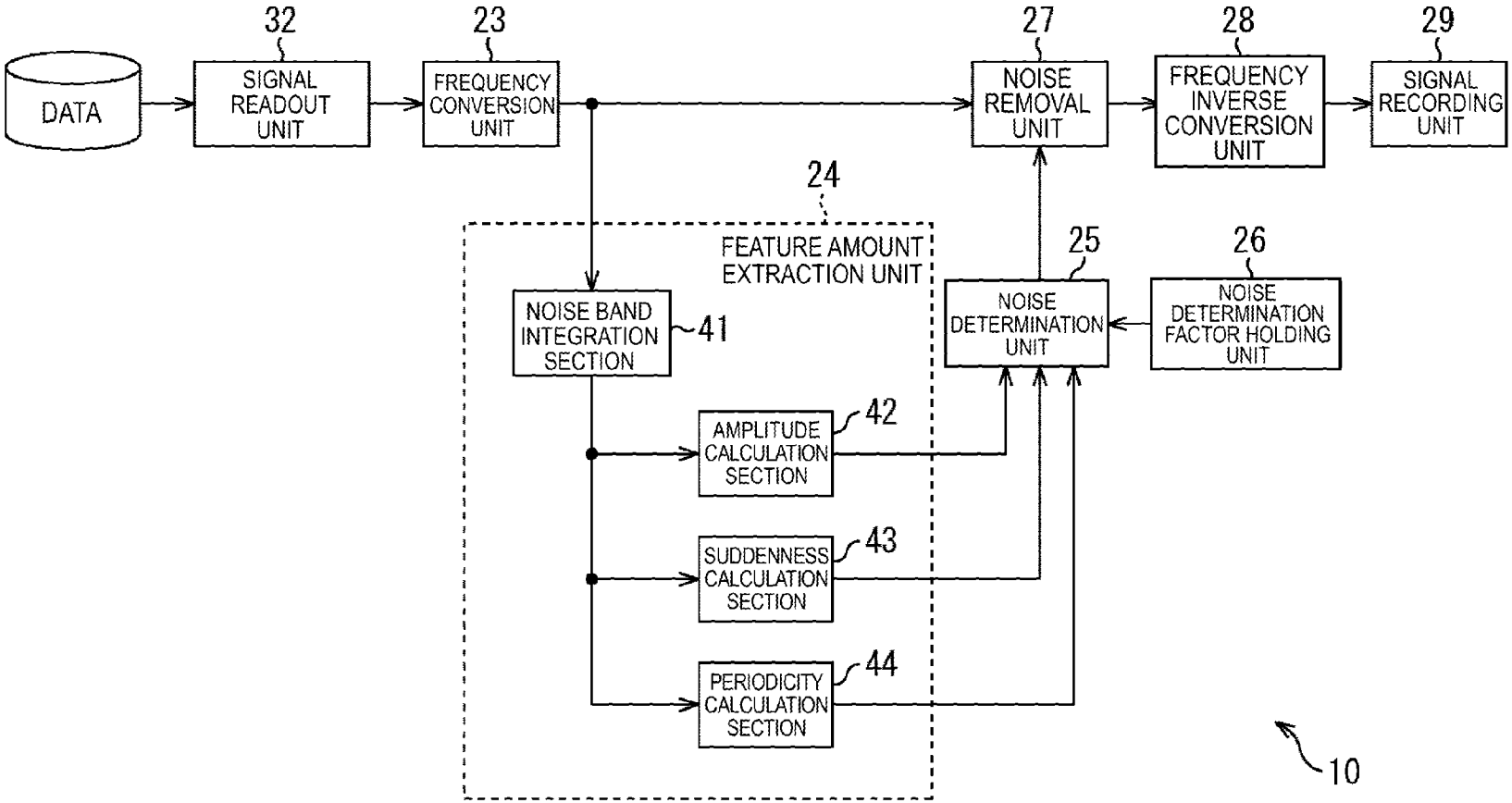
FIG. 17 is a block diagram illustrating still another exemplary configuration of a signal processing device according to an embodiment of the present technology.

FIG. 17 is a block diagram illustrating still another exemplary configuration of the signal processing device according to the embodiment of the present technology.

In the example of the figure, different from the case in FIG. 1, the signal input unit 21 and AD conversion unit 22 are not provided and a signal readout unit 32 is provided in the signal processing device 10.

In the case of the configuration in FIG. 17, the signal processing device 10 is configured to reduce noise contained in the voice obtained by playing back data having been already recorded. The signal readout unit 32 configured to read out and play back the data having been already recorded and to supply the obtained digital voice signal to the frequency conversion unit 23.

The configuration of the other portions in FIG. 17 is similar to that in the case mentioned above in reference to FIG. 1 and their detailed description is omitted.

The signal processing device to which the present technology is applied may be configured as above.

The series of processes described above can be realized by hardware or software. When the series of processes is executed by the software, a program forming the software is installed in a computer embedded in dedicated hardware and a general-purpose personal computer 700 illustrated in FIG. 18 in which various programs can be installed and various functions can be executed, through a network or a recording medium.

Figure 18:
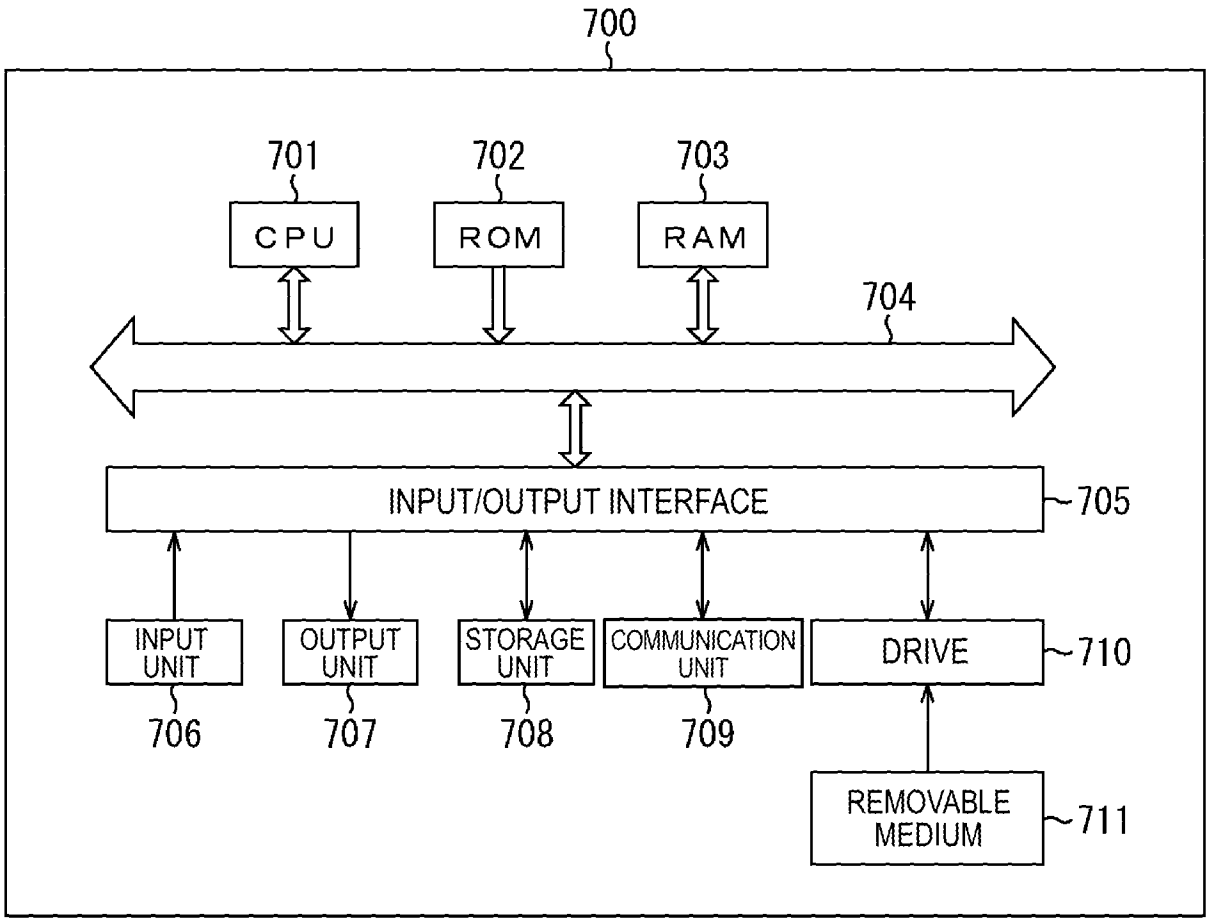
FIG. 18 is a block diagram illustrating an exemplary configuration of a personal computer.

In FIG. 18, a central processing unit (CPU) 701 executes various processes according to a program stored in a read only memory (ROM) 702 or a program loaded from a storage unit 708 to a random access memory (RAM) 703. In the RAM 703, data that is necessary for executing the various processes by the CPU 701 is appropriately stored.

The CPU 701, the ROM 702, and the RAM 703 are connected mutually by a bus 704. Also, an input/output interface 705 is connected to the bus 704.

An input unit 706 that includes a keyboard and a mouse, an output unit 707 that includes a display composed of a liquid crystal display (LCD) and a speaker, a storage unit 708 that is configured using a hard disk, and a communication unit 709 that is configured using a modem and a network interface card such as a LAN card are connected to the input/output interface 705. The communication unit 709 executes communication processing through a network including the Internet.

A drive 710 is connected to the input/output interface 705 according to necessity, removable media 711 such as a magnetic disk, an optical disc, a magneto optical disc, or a semiconductor memory are appropriately mounted, and a computer program that is read from the removable media 711 is installed in the storage unit 708 according to necessity.

When the series of processes is executed by the software, a program forming the software is installed through the network such as the Internet or a recording medium composed of the removable media 711.

The recording medium may be configured using the removable media 711 illustrated in FIG. 18 that is composed of a magnetic disk (including a floppy disk (registered trademark)), an optical disc (including a compact disc-read only memory (CD-ROM) and a digital versatile disc (DVD)), a magneto optical disc (including a mini-disc (MD) (registered trademark)), or a semiconductor memory, which is distributed to provide a program to a user and has a recorded program, different from a device body, and may be configured using a hard disk that is included in the ROM 702 provided to the user in a state embedded in the device body in advance having a recorded program or the storage unit 708.

In the present disclosure, the series of processes includes a process that is executed in the order described, but the process is not necessarily executed temporally and can be executed in parallel or individually.

The embodiment of the present technology is not limited to the above-described embodiment. It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1)

A signal processing device including:

a feature amount extraction unit configured to extract, from a frequency-domain signal obtained by frequency conversion on a voice signal, a feature amount of the frequency-domain signal; and a determination unit configured to determine, based on the extracted feature amount, presence or absence of noise in the voice signal within a predetermined section, wherein the feature amount is composed of a plurality of elements, and wherein the plurality of elements contain an element defined based on a correlation value between a feature amount waveform which is a waveform according to the frequency-domain signal in the voice signal within the predetermined section and a feature amount waveform within another section sequential in time to the predetermined section.

(2)

The signal processing device according to (1), wherein each of the plurality of elements of the feature amount is calculated based on the feature amount waveform within the predetermined section.

(3)

The signal processing device according to (2), wherein the feature amount waveform within the predetermined section is a waveform of a one-dimensional signal obtained by extracting a signal intensity for a preset frequency band from the frequency-domain signal.

(4)

The signal processing device according to any one of (1) to (3), wherein the plurality of elements of the feature amount further contain a maximum value of an amplitude of the feature amount waveform or a value representing suddenness of the feature amount waveform.

(5)

The signal processing device according to any one of (1) to (4), further including:

another feature amount extraction unit extracting a feature amount from the voice signal before the frequency conversion.

(6)

The signal processing device according to any one of (1) to (5), wherein the determination unit determines driving sound of a component driven based on electronic control as the noise, the device further including:

a control signal supply unit configured to supply a control signal representing presence or absence of driving of the component to the feature amount extraction unit.

(7)

The signal processing device according to any one of (1) to (6), further including:

a factor holding unit configured to hold a factor used for determination by the determination unit and beforehand obtained by learning.

(8)

The signal processing device according to (7), wherein the determination unit determines driving sound of a component driven based on electronic control as the noise, the device further including:

a drive information supply unit configure to supply information representing a driving manner of the component to the factor holding unit, and wherein the factor holding unit supplies the factor to the determination unit based on the information supplied from the drive information supply unit.

(9)

The signal processing device according to (7), wherein the determination unit determines the presence or absence of the noise based on an operation result of product-sum operation multiplying the individual plurality of elements of the feature amount by the factor held in the factor holding unit.

(10)

The signal processing device according to (7), wherein the determination unit determines the presence or absence of the noise based on a determination result obtained by threshold determination, based on the factor held in the factor holding unit, on the individual plurality of elements of the feature amount.

(11)

The signal processing device according to any one of (1) to (10), further including:

a noise removal unit removing the noise within the predetermined section when the determination unit determines that the noise is present in the voice signal within the predetermined section.

(12)

The signal processing device according to (11), wherein the noise removal unit extracts a preset frequency band from the frequency-domain signal and performs processing of removing the noise only for the extracted frequency band.

(13)

The signal processing device according to any one of (1) to (12), wherein the voice signal collected by a microphone is inputted.

(14)

The signal processing device according to any one of (1) to (12), wherein the voice signal beforehand recorded is inputted.

(15)

A signal processing method including:

by a feature amount extraction unit, extracting, from a frequency-domain signal obtained by frequency conversion on a voice signal, a feature amount of the frequency-domain signal; and by a determination unit, determining, based on the extracted feature amount, presence or absence of noise in the voice signal within a predetermined section, wherein the feature amount is composed of a plurality of elements, and wherein the plurality of elements contain an element defined based on a correlation value between a feature amount waveform which is a waveform according to the frequency-domain signal in the voice signal within the predetermined section and a feature amount waveform within another section sequential in time to the predetermined section.

(16)

A program for causing a computer to function as a signal processing device including:

a feature amount extraction unit extracting, from a frequency-domain signal obtained by frequency conversion on a voice signal, a feature amount of the frequency-domain signal; and a determination unit determining, based on the extracted feature amount, presence or absence of noise in the voice signal within a predetermined section, wherein the feature amount is composed of a plurality of elements, and wherein the plurality of elements contain an element defined based on a correlation value between a feature amount waveform which is a waveform according to the frequency-domain signal in the voice signal within the predetermined section and a feature amount waveform within another section sequential in time to the predetermined section.

What is claimed is:

1. A signal processing device, comprising:

a central processing unit (CPU) configured to:

extract, from a frequency-domain signal obtained by frequency conversion on a voice signal, a first plurality of features of the frequency-domain signal; and determine, based on the extracted first plurality of features, presence or absence of noise in the voice signal within a first time frame, wherein a first feature of the first plurality of features is defined based on a correlation value between a feature amount waveform, which is a waveform that corresponds to an average intensity of the frequency-domain signal with respect to time, within the first time frame and the feature amount waveform within a second time frame sequential in time to the first time frame, and wherein the CPU is configured to determine the presence or absence of the noise based on a first comparison of a count of individual features of the first plurality of features, each of which satisfy a corresponding condition, with a threshold value.

2. The signal processing device according to claim 1, wherein each of the first plurality of features other than the first feature is calculated based on the feature amount waveform within the first time frame.

3. The signal processing device according to claim 2, wherein the feature amount waveform within the first time frame is a waveform of a one-dimensional signal obtained by extraction of a signal intensity for a set frequency band from the frequency-domain signal.

4. The signal processing device according to claim 1, wherein the first plurality of features further contain a second feature as a maximum value of an amplitude of the feature amount waveform within the first time frame or a third feature as a value that represents suddenness of the feature amount waveform within the first time frame.

5. The signal processing device according to claim 1, wherein the CPU is further configured to extract a second plurality of features from the voice signal before the frequency conversion on the voice signal.

6. The signal processing device according to claim 1, wherein the CPU is further configured to determine driving sound of a component driven based on electronic control as the noise and to supply a control signal that represents presence or absence of driving of the component.

7. The signal processing device according to claim 1, wherein the CPU is further configured to:

determine driving sound of a component driven based on electronic control as the noise, and supply information that represents a driving manner of the component to a memory.

8. The signal processing device according to claim 1, wherein the CPU is further configured to remove the noise within the first time frame based on a determination that the noise is present in the voice signal within the first time frame.

9. The signal processing device according to claim 8, wherein the CPU is further configured to extract a set frequency band from the frequency-domain signal and remove the noise for the extracted set frequency band.

10. The signal processing device according to claim 1, wherein the voice signal collected by a microphone is input.

11. The signal processing device according to claim 1, wherein the voice signal recorded beforehand is input.

12. The signal processing device according to claim 1, wherein the noise is determined to be present based on a determination that the count of the individual features of the first plurality of features, each of which satisfies the corresponding condition, is greater than or equal to the threshold value.

13. The signal processing device according to claim 1, wherein the individual features of the first plurality of features satisfies the corresponding condition based on a second comparison of a corresponding feature amount of the individual features with a corresponding determined value.

14. A signal processing method, comprising:

in a device comprising a processor:

extracting, from a frequency-domain signal obtained by frequency conversion on a voice signal, a plurality of features of the frequency-domain signal; and determining, based on the extracted plurality of features, presence or absence of noise in the voice signal within a first time frame, wherein at least one feature of the plurality of features is defined based on a correlation value between a feature amount waveform, which is a waveform of an average intensity of the frequency-domain signal with respect to time, within the first time frame and the feature amount waveform within a second time frame sequential in time to the first time frame, and wherein the presence or absence of the noise is determined based on a comparison of a count of individual features of the plurality of features, each of which satisfy a corresponding condition, with a threshold value.

15. A non-transitory computer-readable storage medium having stored thereon, computer-executable instructions for causing a computer to execute operations, the operations comprising:

extracting, from a frequency-domain signal obtained by frequency conversion on a voice signal, a plurality of features of the frequency-domain signal; and determining, based on the extracted plurality of features, presence or absence of noise in the voice signal within a first time frame, wherein at least one feature of the plurality of features is defined based on a correlation value between a feature amount waveform, which is a waveform of an average intensity of the frequency-domain signal with respect to time, within the first time frame and the feature amount waveform within a second time frame sequential in time to the first time frame, and wherein the presence or absence of the noise is determined based on a comparison of a count of individual features of the plurality of features, each of which satisfy a corresponding condition, with a threshold value.

* * * * *